US005524585A

United States Patent [19]

Conoscenti

[11] Patent Number: 5,524,585

[45] Date of Patent: Jun. 11, 1996

[54] AIR CLEANER HOUSING

[76] Inventor: Rosario J. Conoscenti, 1622 E. Walnut, Des Plaines, Ill. 60016

[21] Appl. No.: 448,117

[22] Filed: May 23, 1995

[51] Int. Cl.[6] ..... F02B 77/00

[52] U.S. Cl. ..... 123/198 E; 55/385.3; 55/418; 55/484; 55/495

[58] Field of Search ..... 123/198 E; 55/385.3, 55/418, 484, 495, 497

[56] References Cited

U.S. PATENT DOCUMENTS

| | | | |
|---|---|---|---|
| 1,586,980 | 5/1923 | Du Pont | 55/385.3 |
| 3,673,995 | 7/1972 | Mangin | 123/198 E |
| 3,710,562 | 1/1973 | McKenzie | 55/487 |
| 4,208,197 | 6/1980 | Yakimowich et al. | 55/315 |
| 5,120,334 | 6/1992 | Cooper | 55/385.3 |
| 5,125,940 | 6/1992 | Stanhope et al. | 55/385.3 |
| 5,400,753 | 3/1995 | Andress et al. | 123/198 E |

*Primary Examiner* Noah P. Kamen
*Attorney, Agent, or Firm* Welsh & Katz, Ltd.

[57] ABSTRACT

An air cleaner apparatus for an internal combustion engine having a filter element with a generally planar face disposed in a direction parallel to the flow of air, the apparatus includes a central portion and an air guide disposed adjacent the central portion. The central portion communicates with the air guide through the filter element. The central portion has at least one air inlet in operative communication with the engine for permitting the flow of air from the air guide through the filter element and into the engine. The air guide includes an air scoop and an air exhaust, each disposed in a plane generally perpendicular to the direction of the flow of air relative to the housing. The air scoop and the air exhaust are disposed at opposite ends of the filter element such that a portion of the flow of air entering the air guide through the air scoop enters the central portion through the face of the filter element. The remainder of the flow of air exits the air guide through the air exhaust.

20 Claims, 3 Drawing Sheets

AIR CLEANER HOUSING

BACKGROUND OF THE INVENTION

The present invention relates generally to an air cleaner for an internal combustion engine and more specifically to an air cleaner housing having a filter element disposed within the housing and an air guide configured to increase the velocity and reduce the temperature of the air flowing into the engine.

Air cleaners for internal combustion engines have taken a variety of forms, such as wet filters and dry filters arranged in a wide variety of sizes and shapes. Many internal combustion engines are provided with a carburetor where the air supply for the carburetor is drawn through an air intake by suction created by the engine cylinders. In fuel injected engines, the carburetor is eliminated but the engine still requires an air supply from an air intake to support combustion.

The air intake typically draws air from some point under the hood of the vehicle. The air beneath the hood of the vehicle is usually contaminated with grit, dust and other particulate matter, which could be sucked into the air intake. The grit and particulate matter, if not removed, tends to clog the carburetor or fuel injection system and reduces engine efficiency and may even cause damage to the engine. In typical filter arrangements, a quantity of the grit and particulate matter passes with the air mixture through the filter element and into the engine cylinders acting to damage the valves and cylinder walls. The dust and grit form deposits on the cylinder walls of the combustion chamber increasing carbon built-up which causes pre-ignition, commonly known as "knocking".

All internal combustion engines provide a form of filtering in an attempt to reduce the amount of dirt, grit and dust entering the engine. One drawback of present filter arrangements is that the filter typically provides the only path through which the air flow may pass. Thus, all of the grit and dust in the air flow encounters the air filter. Some of the particulate matter passes through the filter and into the engine while most is trapped by the filter. This causes the filter to become clogged with the dirt and dust, thus decreasing the ability of the filter to trap additional dirt and dust and also decreasing the flow of air through the filter.

If the filter is not frequently changed, it becomes clogged beyond its operating capacity and engine efficiency is reduced and the engine may be damaged. Changing the filter is an annoying task and is often postponed beyond the time when required. Depending upon the type of engine, frequent changing of the air filter may be expensive.

Typical air filter housings have little impact upon the temperature of the air flow which reaches the engine. The flow of air simply enters through an aperture and passes through the air filter and into the engine. Some known filter housings provide a venturi device fixed to the housing to smooth the flow of air to reduce turbulence in the air flow in an attempt to improve engine efficiency.

Other known filter housing arrangements provide flaps, valves or shutters which attempt to modify the temperature of the air flow entering the engine. Such devices typically include sensors to monitor the temperature and also require a means to activate the flaps or valves in response to the measured temperature. These known devices are expensive and difficult to maintain.

Accordingly, it is an object of the present invention to overcome the above problems.

It is another object of the present invention to provide a novel air cleaner housing which provides the engine with a clean source of air by reducing filter element clogging by dirt and debris.

It is a further object of the present invention to provide a novel air cleaner housing that reduces the temperature of the flow of air reaching the engine to improve engine efficiency.

It is yet another object of the present invention to provide a novel air cleaner housing that is simple in construction and contains no moving parts.

SUMMARY OF THE INVENTION

The disadvantages of known air cleaner housings are substantially overcome with the present invention by providing a novel air cleaner housing that is easily retrofitted to existing engines. The air cleaner reduces the temperature of the flow of air reaching the engine by providing air guides having a reduced cross-sectional portion to increase the velocity of the air flow therethrough. The increase in the velocity of the air flow reduces the temperature of the air.

The air cleaner housing also reduces the clogging of the filter element by dirt and debris by allowing the dirt and debris to bypass the filter element and exit through an air exhaust. The filter remains cleaner and free of dirt and particulate matter for a greater period of time than with conventional air cleaner housings. Thus, the air entering the engine is extremely clean and free from contaminants.

Cooler air temperature and cleaner air entering the engine results in improved engine efficiency. Since less debris and contaminants enter the engine cylinders, spark plug useful life is extended, engine horsepower is increased and fuel consumption is decreased. Engine wear is also reduced along with engine emissions.

More specifically, the air cleaner apparatus for an internal combustion engine of the present invention includes a filter element with a generally planar face disposed parallel to a direction of air flow. The apparatus includes a housing having a central portion and an air guide disposed adjacent the central portion where the central portion communicates with the air guide through the filter element. The central portion has at least one air inlet in operative communication with the engine for permitting the flow of air from the air guide through the filter element and into the engine. The air guide includes an air scoop and an air exhaust, each disposed in a plane generally perpendicular to the direction of the flow of air relative to the housing. The air scoop and the air exhaust are disposed at opposite ends of the filter element such that a portion of the flow of air entering the air guide through the air scoop enters the central portion through the face of the filter element. The remainder of the flow of air exits the air guide through the air exhaust.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION OF THE INVENTION

Figure 1:
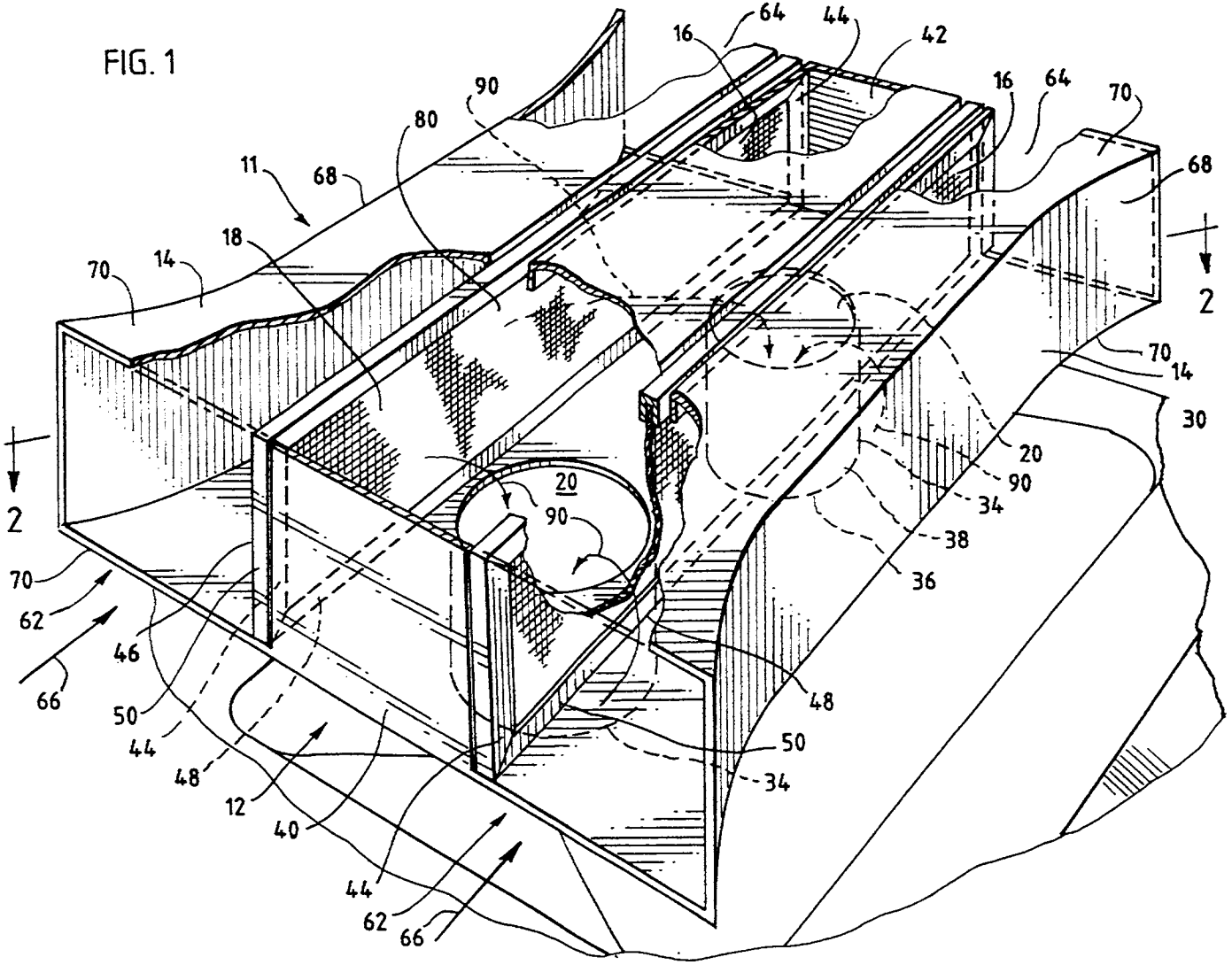
FIG. 1 is a perspective view of a specific embodiment of an air filter housing.
Figure 2:
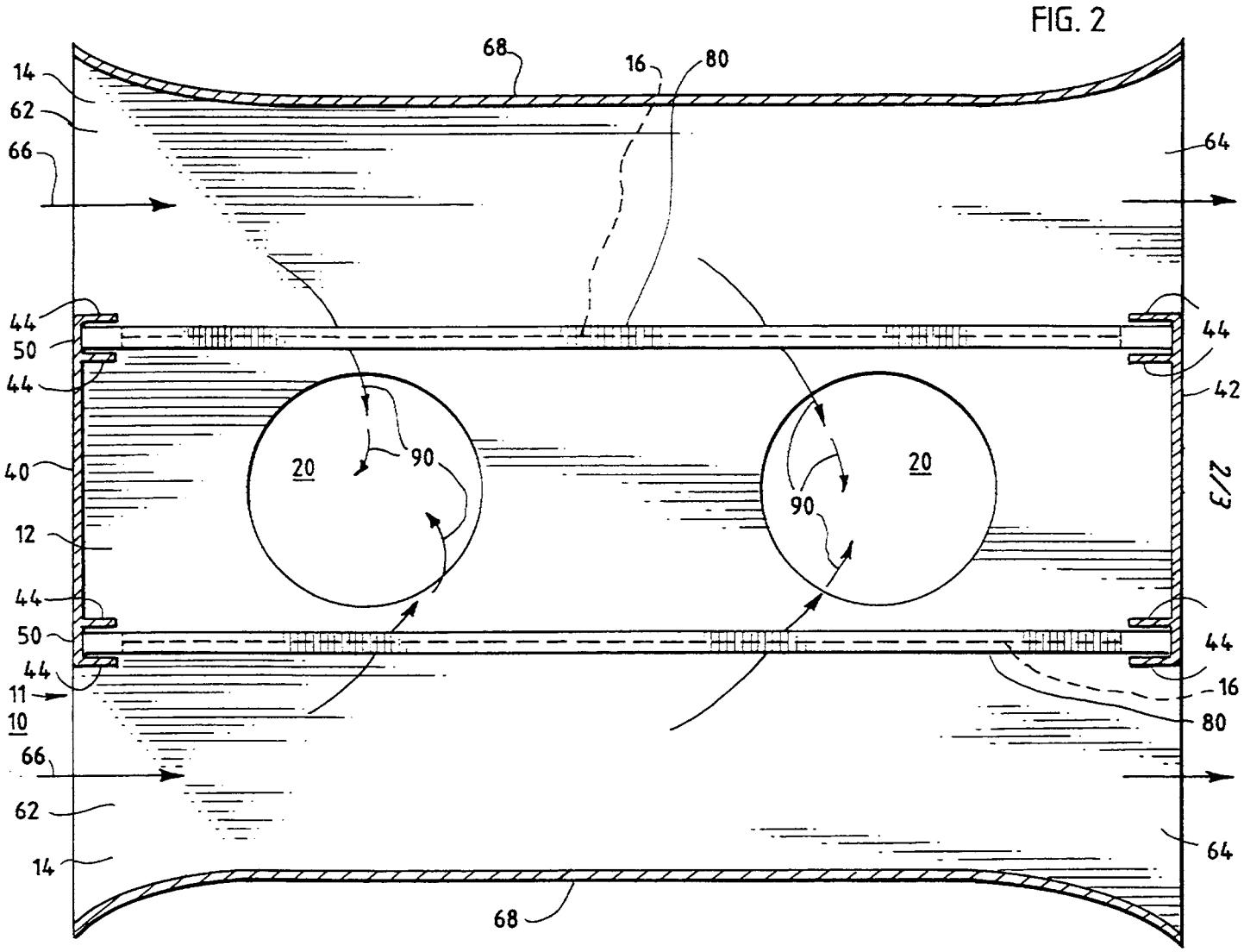
FIG. 2 is a top plan view of the air filter housing shown in FIG. 1.

Referring now to FIGS. 1 and 2, a specific embodiment of an air cleaner apparatus 10 is shown generally. The apparatus 10 includes a housing 11 having a central portion 12 and two air guides 14 disposed on opposite sides of the central portion. A pair of filter elements 16 is disposed between an inner boundary 18 of each air guide 14 and the central portion 12.

In the illustrated embodiment, the air guides 14 are shown coupled to each side of the central portion 12. However, a single air guide 14 coupled to one side of the central portion 12 may also be used. The central portion 12 communicates with each air guide 14 through the filter elements 16 such that the only air path into the central portion is through the air filter. The housing 11 may be constructed from metal, such as aluminum or tin and the like or may be formed from heat resistant plastic suitable for molding and extrusion techniques.

The central portion 12 includes at least one air inlet 20 in operative communication with an engine 30 for permitting the flow of air through the filter elements 16 and into the engine. Each air inlet 20 is coupled to a portion of the engine 30 which directs the flow of air into the engine. For carburetted engines, each air inlet 20 is coupled to a neck 34 of a carburetor 36 by a seal or clamp mechanism, as is well known in the art. For engines 30 without carburetors 36, each air inlet 20 is coupled to an air intake pipe 38 by a similar method. In the illustrated embodiment, two air inlets 20 are shown. However, the housing 11 may have only a single air inlet 20 coupled to a single carburetor 36 or single air intake pipe 38. Alternatively, the housing 11 may include multiple air inlets 20 equal to the number of carburetors 36 or air intake pipes 38 provided by the engine 30.

The central portion 12 is essentially a closed chamber with the filter elements 16 providing air-permeable walls on opposite sides of the air inlets 20. A front wall 40 and a back wall 42 of the central portion 12 are solid and may be integrally formed with the housing 11. Thus, the only path for air flow entering the central portion 12 is through the air inlets 20 and into the engine 30. The filter elements 16 may be supported between the central portion 12 and the air guides 14 by slots or grooves 44 disposed along upstanding edges 46 of the front wall 40 and the back wall 42. Similar slots or grooves 44 may also be provided along a bottom edge 48 common to the central portion 12 and the air guides 14.

The slots or grooves 44 are sufficiently wide to receive an edge 50 of the filter elements 16 and to allow for easy withdrawal and replacement of the filter elements. The slots or grooves 44 are also sufficiently narrow to hold the filter elements 16 firmly in place while preventing air flow around the edges. A top cover (not shown) seals the top of the central portion 12 and may be affixed to the housing 11 by bolts, clips, screws and the like, as is well known in the art. The filter elements 16, for example, may be commercially available corrugated filters or any other standard replacement air filters.

Each air guide 14 includes an open air scoop 62 and an open air exhaust 64, each disposed in a plane generally perpendicular to the direction of the flow of air 66 relative to the housing 11. The direction of the flow of air is shown by arrows 66. The air guides 14 include a solid outer side wall 68 extending between the air scoop 62 and the air exhaust 62, and further include a top and bottom solid wall 70. The outer side wall 68 is disposed in a generally spaced relationship to a face 80 of the filter element 16 although the distance therebetween may vary, as will be described hereinafter. Thus, each air guide 14 is bounded on four sides by the top and bottom walls 70, the outer side wall 68, and the filter element 16. The air guides 14 are open in the direction of air flow 66 from the air scoop 62 to the air exhaust In the preferred embodiment, the outer side wall 68 curves inward toward the face 80 of the filter element 16 to reduce the cross sectional area of the air guide 14 along a portion of the air guide between the air scoop 62 and the air exhaust 64. The contour of the outer side wall 68 may be a smooth curve or may be formed from a plurality of substantially linear sections, as is well known in the art. The reduction in cross-sectional area and subsequent increase in cross-sectional area of the air guide 14 increases the velocity of the flow of air 66 through the air guide. This is essentially a "venturi" effect which also reduces the temperature of the flow of air 66 which passes through the air guide 14 and through the filter elements 16 and into the air inlets 20, as shown by arrow 90. To facilitate the increase in the velocity of the flow of air 66 through the air guide 14 and to enhance the venturi effect, the cross-sectional area of the air exhaust 64 may be greater than the cross-sectional area of the air scoop 62.

Figure 3:
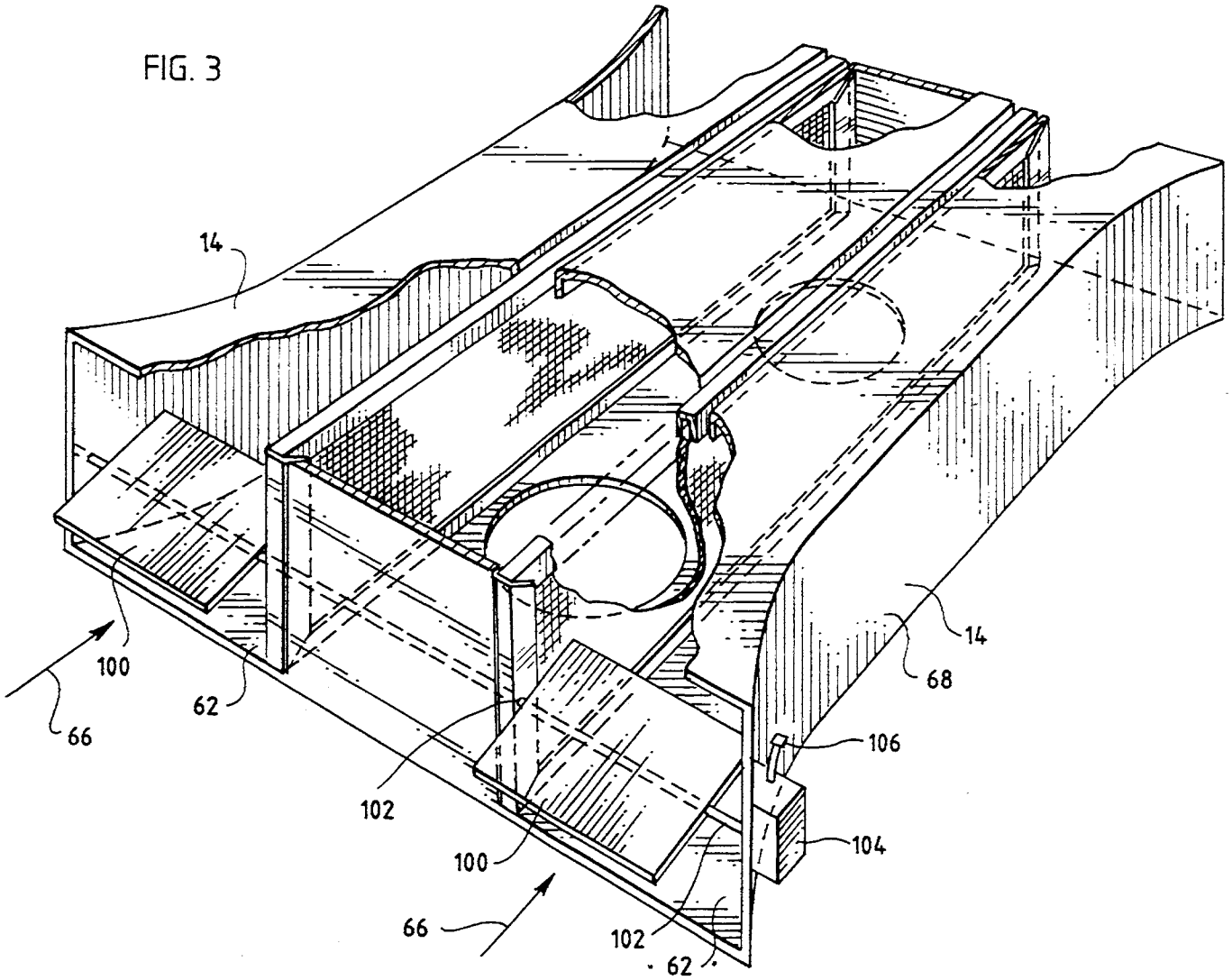
FIG. 3 is a perspective view of an alternate embodiment of an air filter housing.

Referring now to FIG. 3, an alternate embodiment of the air cleaner housing 11 is shown. In this embodiment, each air scoop 62 is equipped with a butterfly-type gate 100 operatively coupled to the air guide 14. The gate 100 is configured to provide an adjustable aperture to vary the volume of air entering the air scoop 62. The butterfly gate 100 is pivotally mounted in the air scoop 62 by a pair of support studs 102 which allow the gate 100 to pivot, thus regulating the effective size of the air scoop 62 and hence regulating the flow of air 66. A control module 104 mounted on the outer side wall 68 controls rotation of the support studs 102 in response to the temperature of the air entering the air scoop 62. Rotation of the support studs 102, in turn, rotates the gate 100. The control module 104 may receive temperature information from a temperature sensor 106 and may also receive engine temperature information from additional temperature sensors (not shown) so that air flow is optimized based upon ambient air temperature and engine temperature.

Referring back to FIGS. 1 and 2, in operation, due to the direction of the flow of air 66 generally, air enters the air guides 14 through the air scoops 62. As the air flows toward the air exhausts 62, it encounters the reduced cross-section of the air guide 14 and increases in velocity. The increase in velocity reduces the temperature of the air in accordance with the venturi effect, as is well known. A portion of the air flow 66 is sucked through the filter elements 16 along the face 80 of the filter elements and enters the central portion 12. The cooled air 90 then enters the engine 30 through the air inlets 20. Since a portion of this air supplied to the engine 30 is reduced in temperature, engine efficiency is increased.

The flow of air 66 entering the air guides 14 contains dust, debris, grit and other particulate matter detrimental to engine performance and the useful life of filter element 16. Since the air exhaust 64 is open, a portion of the air flow 66 exits the air guide 14 without interacting with the filter elements 16. Due to the increase in the air flow velocity coupled with the open path available for the flow of air 66, most of the dust, debris, grit and other particulate matter passes directly from the air scoop 62 out through the air exhaust 64 and does not significantly contact, adhere to, or otherwise clog the filter elements 16. Although suction from the engine 30 causes air to be diverted from the air guides 14 through the filter elements 16 and into the central portion 12, the particulate matter is generally not diverted into the filter elements. Thus, the majority of contaminants in the air flow 66 is "blown" out of the air exhaust 64 and does not clog the filter elements 16. This greatly extends the useful life of the filter elements 16 and increases the quality of the air 90 entering the engine 30. The increase in air quality results in increased engine efficiency and increased horsepower, and a reduction in emissions and engine wear.

A specific embodiment of an air cleaner housing apparatus according to the present invention has been described for the purpose of illustrating the manner in which the invention may be made and used. It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

What is claimed is:

1. An air cleaner apparatus for an internal combustion engine, the air cleaner having a filter element with a generally planar face disposed parallel to a direction of a flow of air, the air cleaner comprising:

a housing having a central portion and an air guide disposed adjacent the central portion, said central portion communicating with the air guide through the filter element;

the central portion having at least one air inlet in operative communication with the engine for permitting the flow of air from the air guide through the filter element and into the engine;

the air guide having an air scoop and an air exhaust, each disposed in a plane generally perpendicular to the direction of the flow of air relative to the housing;

the air scoop and the air exhaust disposed at opposite ends of the filter element, a portion of the flow of air moving in the air guide through the air scoop entering the central portion through the face of the filter element and a remainder of the flow of air exiting the air guide through the air exhaust.

2. The apparatus according to claim 1 wherein the air guide includes an outer wall extending between the air scoop and the air exhaust and being in a generally spaced relationship to the face of the filter element, said outer wall being curved inward toward the filter element between the air scoop and the air exhaust to reduce the cross-sectional area of the air guide between the air scoop and the air exhaust, said air guide configured to increase the velocity of the flow of air therethrough to minimize clogging of the filter element and to reduce the temperature of the flow of air passing into the engine.

3. The apparatus according to claim 2 wherein the cross-sectional area of the air exhaust is greater than the cross-sectional area of the air scoop to increase the velocity of the flow of air through the air guide.

4. The apparatus according to claim 1 wherein the central portion and the air guide are generally rectangular in cross-section.

5. The apparatus according to claim 1 wherein the at least one air inlet is in operative communication with at least one carburetor, respectively, such that the flow of air entering the at least one air inlet is directed into the at least one carburetor.

6. The apparatus according to claim 5 wherein the central portion of the housing is configured to releasably and sealingly mate with a portion of the carburetor such that the at least one air inlet forms a substantially air-tight seal with at least one carburetor.

7. The apparatus according to claim 1 wherein the at least one air inlet is in operative communication with at least one air intake pipe such that the flow of air entering the at least one air inlet is directed into the at least one air intake pipe.

8. The apparatus according to claim 7 wherein the central portion of the housing is configured to releasable and sealingly mate with a portion of the air intake pipe such that the at least one air inlet forms a substantially air-tight seal with the air intake pipe.

9. The apparatus according to claim 1 including an adjustable gate operatively coupled to the air guide to vary the volume of the flow of air entering the air scoop.

10. The apparatus according to claim 9 wherein the position of the adjustable gate is varied in response to the temperature of the air entering the air scoop.

11. The apparatus according to claim 9 wherein the position of the adjustable gate is varied in response to the temperature of the engine.

12. An air cleaner apparatus for an internal combustion engine, the air cleaner having filter elements with a generally planar face disposed parallel to a direction of a flow of air, the air cleaner comprising:

a housing having a central portion;

a first and a second air guide;

said first and second air guides being disposed along opposite sides of the central portion, respectively, said central portion communicating with each air guide through a first and second filter element, respectively;

the central portion having at least one air inlet in operative communication with the engine for permitting the flow of air from the air guides through the filter elements, and into the engine;

each air guide having an air scoop and an air exhaust, each disposed in a plane generally perpendicular to the direction of the flow of air relative to the housing; and each air scoop and each air exhaust disposed at opposite ends of the filter elements, respectively, a portion of the flow of air moving in the air guides through the air scoops entering the central portion through the face of the filter elements, respectively, and a remainder of the flow of air exiting the air guides through the air exhausts.

13. The apparatus according to claim 12 wherein each air guide includes an outer wall extending between the air scoop and the air exhaust, respectively, the outer wall being in a generally spaced relationship to the face of the filter elements, said outer walls being curved inward toward the filter elements between the air scoops and the air exhaust to reduce the cross-sectional area of the air guides between the air scoops and air exhausts, said air guides configured to increase the velocity of the flow of air therethrough to minimize clogging of the filter elements and to reduce the temperature of the flow of air passing into the engine.

14. The apparatus according to claim 12 wherein the cross-sectional area of the air exhaust is greater than the cross-sectional area of the air scoop to increase the velocity of the flow of air through the air guides.

15. The apparatus according to claim 12 wherein the at least one air inlet is in operative communication with at least one carburetor, respectively, such that the flow of air entering the at least one air inlet is directed into the at least one carburetor.

16. The apparatus according to claim 15 wherein the central portion of the housing is configured to releasably and sealingly mate with a portion of the carburetor such that the at least one air inlet forms a substantially air-tight seal with the at least one carburetor.

17. The apparatus according to claim 12 wherein the at least one air inlet is in operative communication with at least one air intake pipe such that the flow of air entering the at least one air inlet is directed into the at least one air intake pipe.

18. The apparatus according to claim 17 wherein the central portion of the housing is configured to releasable and sealingly mate with a portion of the air intake pipe such that the at least one air inlet forms a substantially air-tight seal with the air intake pipe.

19. An air cleaner apparatus for an internal combustion engine, the air cleaner having filter elements with a generally planar face disposed parallel to a direction of a flow of air, the air cleaner comprising:

a housing having a central portion;

a first and a second air guide;

said first and second air guides being disposed adjacent opposite sides of the central portion, respectively, said central portion communicating with each air guide through a first and second filter element, respectively;

the central portion having at least one air inlet in operative communication with the engine for permitting the flow of air from the air guides through the filter elements and into the engine;

each air guide having an air scoop and an air exhaust, each disposed in a plane generally perpendicular to the direction of the flow of air relative to the housing;

each air scoop and each air exhaust disposed at opposite ends of the filter elements, respectively, a portion of the flow of air moving in the air guides through the air scoops entering the central portion through the face of the filter elements, respectively, and a remainder of the flow of air exiting the air guides through the air exhausts; and each air guide having an outer wall extending between the air scoop and the air exhaust, respectively, the outer walls being in a generally spaced relationship to the face of the filter elements, said outer walls being curved inward toward the filter elements between the air scoops and the air exhausts to reduce the cross-sectional area of the air guides between the air scoops and air exhausts, said air guides configured to increase the velocity of the flow of air therethrough to minimize clogging of the filter elements and to reduce the temperature of the flow of air passing into the engine.

20. The apparatus according to claim 19 wherein the cross-sectional area of the air exhaust is greater than the cross-sectional area of the air scoop to increase the velocity of the flow of air through the air guide.

* * * * *